US009435605B2

(12) United States Patent
McPherson et al.

(10) Patent No.: US 9,435,605 B2
(45) Date of Patent: Sep. 6, 2016

(54) SAFETY TRIGGER MECHANISM FOR A CROSSBOW

(71) Applicant: MCP IP, LLC, Sparta, WI (US)

(72) Inventors: Mathew A. McPherson, Norwalk, WI (US); Gary L. Simonds, Gainesville, FL (US)

(73) Assignee: MCP IP, LLC, Sparta, WI (US)

( * ) Notice: Subject to any disclaimer, the term of this patent is extended or adjusted under 35 U.S.C. 154(b) by 73 days.

(21) Appl. No.: 14/099,829

(22) Filed: Dec. 6, 2013

(65) Prior Publication Data

US 2014/0174419 A1 Jun. 26, 2014

Related U.S. Application Data

(60) Provisional application No. 61/734,193, filed on Dec. 6, 2012.

(51) Int. Cl.

| | |
|---|---|
| ***F41B 5/12*** | (2006.01) |
| ***F41B 5/18*** | (2006.01) |
| ***F41A 17/46*** | (2006.01) |
| ***F41B 5/14*** | (2006.01) |

(52) U.S. Cl.

CPC ..... *F41B 5/12* (2013.01); *F41A 17/46* (2013.01); *F41B 5/1469* (2013.01)

(58) Field of Classification Search

CPC ..... F41B 5/1469; F41B 5/12; F41A 17/46
USPC ..... 124/25, 31, 35.1, 35.2, 40, 86
See application file for complete search history.

(56) References Cited

U.S. PATENT DOCUMENTS

| | | | | |
|---|---|---|---|---|
| 3,670,711 A | | 6/1972 | Firestone | |
| 4,030,473 A | | 6/1977 | Puryear | |
| 4,169,456 A | | 10/1979 | Van House | |
| 4,192,281 A | * | 3/1980 | King | F41B 5/1469 124/25 |
| 4,388,914 A | | 6/1983 | Cesin | |
| 4,479,480 A | | 10/1984 | Holt | |
| 4,662,345 A | | 5/1987 | Stephens | |
| 4,665,886 A | | 5/1987 | Barlow | |
| 4,688,539 A | | 8/1987 | Lawrence | |
| 4,693,228 A | | 9/1987 | Simonds et al. | |
| 4,697,571 A | | 10/1987 | Waiser | |
| 4,716,880 A | | 1/1988 | Adkins | |
| 4,721,092 A | * | 1/1988 | Waiser | F41B 5/1469 124/25 |
| 4,877,008 A | * | 10/1989 | Troubridge | F41B 5/1469 124/25 |
| 5,025,771 A | * | 6/1991 | Hanson | F41B 5/1469 124/25 |

(Continued)

FOREIGN PATENT DOCUMENTS

| | | |
|---|---|---|
| CN | 202993971 | 6/2013 |

OTHER PUBLICATIONS

Sly Fox, "Use the Sly Fox Release to decock your crossbow without firing a bolt!" L&L Crossbow Release Aid, Retrieved from http://www.slycrossbowrelease.com/ on Feb. 11, 2014.

*Primary Examiner* — Alexander Niconovich

(57) ABSTRACT

In at least one embodiment, a crossbow trigger assembly comprises a housing, a string catch and a trigger arranged to release the string catch. A safety member is moveable between safe and fire orientations, which prevents actuation of the trigger while in the safe orientation. An arrow sensing member is moveable between first and second orientations and prevents the safety member from assuming the fire orientation when the arrow sensing member is in the first orientation.

19 Claims, 10 Drawing Sheets

(56) References Cited

U.S. PATENT DOCUMENTS 5,085,200 A * 2/1992 Horton-Corcoran . F41B 5/1469 124/25
5,596,976 A * 1/1997 Waiser ..... F41B 5/12 124/25
5,598,829 A * 2/1997 Bednar ..... F41A 17/28 124/25
5,649,520 A * 7/1997 Bednar ..... F41B 5/12 124/25
5,884,614 A * 3/1999 Darlington ..... F41B 5/1469 124/25
6,205,990 B1 * 3/2001 Adkins ..... F41B 5/12 124/25
6,425,386 B1 * 7/2002 Adkins ..... F41B 5/12 124/25
6,736,123 B1 * 5/2004 Summers ..... F41A 17/46 124/25
6,799,566 B1 10/2004 Malucelli
6,802,304 B1 * 10/2004 Chang ..... F41B 5/1469 124/25
7,017,568 B1 3/2006 Smith
7,174,884 B2 * 2/2007 Kempf ..... F41B 5/105 124/25
7,588,022 B2 * 9/2009 Chang ..... F41B 5/123 124/25
7,770,567 B1 * 8/2010 Yehle ..... F41A 17/46 124/25
7,779,824 B2 * 8/2010 Bednar ..... F41B 5/10 124/25
7,784,453 B1 8/2010 Yehle
7,810,480 B2 * 10/2010 Shepley ..... F41A 11/02 124/25
7,814,894 B2 * 10/2010 Giroux ..... F41B 5/12 124/25
7,997,258 B2 * 8/2011 Shepley ..... F41B 5/12 124/25
8,020,543 B2 * 9/2011 Maleski ..... F41B 5/12 124/25
8,091,540 B2 * 1/2012 Matasic ..... F41B 5/12 124/25
8,240,299 B2 * 8/2012 Kronengold ..... F41A 11/02 124/25
8,312,869 B2 11/2012 Gillet
8,375,928 B1 2/2013 Bednar et al.
8,453,631 B1 * 6/2013 Kronengold ..... F41A 11/02 124/25
8,522,761 B1 * 9/2013 Chu ..... F41A 17/46 124/25
8,602,013 B2 * 12/2013 Bednar ..... F41B 5/12 124/25
8,651,094 B2 * 2/2014 Matasic ..... F41B 5/12 124/23.1
8,656,899 B2 * 2/2014 Bednar ..... F41B 5/12 124/25
8,770,178 B2 * 7/2014 Kempf ..... F41A 19/10 124/25
8,857,420 B2 * 10/2014 Grace ..... F41B 5/123 124/25
8,931,465 B1 * 1/2015 Choma ..... F41B 5/12 124/25
8,985,091 B2 * 3/2015 Miao ..... F41B 5/12 124/25
9,010,308 B1 * 4/2015 Hyde ..... F41B 5/1469 124/25
2009/0064978 A1 * 3/2009 Matasic ..... F41B 5/12 124/35.1
2009/0078243 A1 * 3/2009 Bednar ..... F41B 5/1469 124/31
2012/0048252 A1 * 3/2012 Chu ..... F41B 5/12 124/25
2013/0098343 A1 * 4/2013 Grace ..... F41B 5/123 124/25
2013/0312724 A1 11/2013 Hudkins
2014/0076296 A1 * 3/2014 Kempf ..... F41B 5/12 124/35.1
2014/0102431 A1 * 4/2014 Kennedy ..... F41B 5/12 124/35.1
2014/0182574 A1 * 7/2014 Darlington ..... F41B 5/1403 124/35.1

* cited by examiner

SAFETY TRIGGER MECHANISM FOR A CROSSBOW

CROSS-REFERENCE TO RELATED APPLICATIONS

This application claims the benefit of U.S. Provisional Patent Application No. 61/734,193, filed Dec. 6, 2012, the entire disclosure of which is hereby incorporated herein by reference.

BACKGROUND OF THE INVENTION

This invention relates generally to projectile devices such as crossbows, and more specifically to a trigger and safety mechanism.

Crossbows are generally known in the art. In general, a bowstring is retained in a cocked orientation by a string catch, and actuation of a trigger releases the bowstring. Desirably, a safety mechanism is provided that will prevent actuation of the trigger when the safety mechanism is engaged.

There remains a need for inventive trigger and safety designs.

A crossbow may also include a dry fire prevention mechanism, which desirably prevents a full release (e.g. dry fire snap) of the bowstring unless an arrow or bolt is positioned to be fired. For example, U.S. Pat. No. 5,598,829 teaches a dry fire prevention mechanism having a secondary catch arranged to catch the bowstring shortly after release from the primary catch upon trigger actuation, if an arrow is not in place. U.S. Pat. No. 5,085,200, U.S. Pat. No. 5,884,614, U.S. Pat. No. 6,802,304 and U.S. Pat. No. 7,770,567 teach further examples of crossbow trigger mechanisms.

There remains a need for inventive dry fire prevention devices that provide benefits over prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, a crossbow trigger assembly comprises a housing, a string catch and a trigger arranged to release the string catch. A safety member is moveable between safe and fire orientations, which prevents actuation of the trigger while in the safe orientation. An arrow sensing member is moveable between first and second orientations and prevents the safety member from assuming the fire orientation when the arrow sensing member is in the first orientation.

Desirably, the arrow sensing member assumes the second orientation when an arrow is present, wherein the arrow sensing member does not prevent the safety member from assuming said fire orientation.

In at least one embodiment, a crossbow trigger assembly comprises a string catch and a trigger arranged to release the string catch. A safety member is moveable between safe and fire orientations, which prevents actuation of the trigger while in the safe orientation. An arrow sensing member is moveable between first and second orientations and prevents the safety member from assuming the fire orientation when the arrow sensing member is in the first orientation. The safety member comprises a body arranged to contact the trigger and the arrow sensing member simultaneously.

In at least one embodiment, a crossbow trigger assembly comprises a string catch and a trigger arranged to release the string catch. A safety member that comprises a single body is moveable between safe and fire orientations. The safety member prevents actuation of the trigger while in the safe orientation. An arrow sensing member comprises a single body that is moveable between first and second orientations and prevents the safety member from assuming the fire orientation when the arrow sensing member is in the first orientation. The safety member contacts the trigger and the arrow sensing member simultaneously.

These and other embodiments which characterize the invention are pointed out with particularity in the claims annexed hereto and forming a part hereof However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
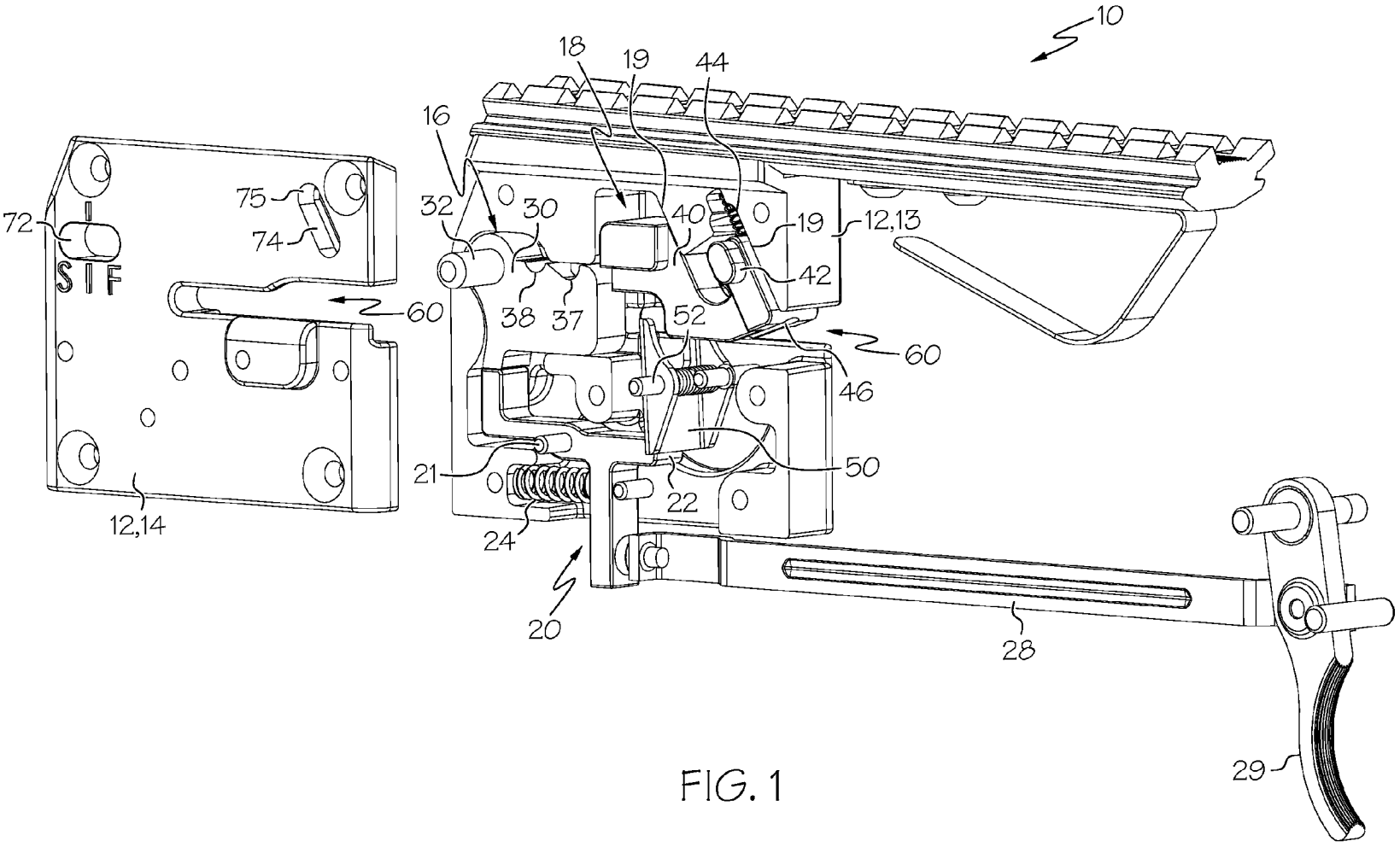
FIGS. 1-3 show various views of an embodiment of a trigger assembly.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
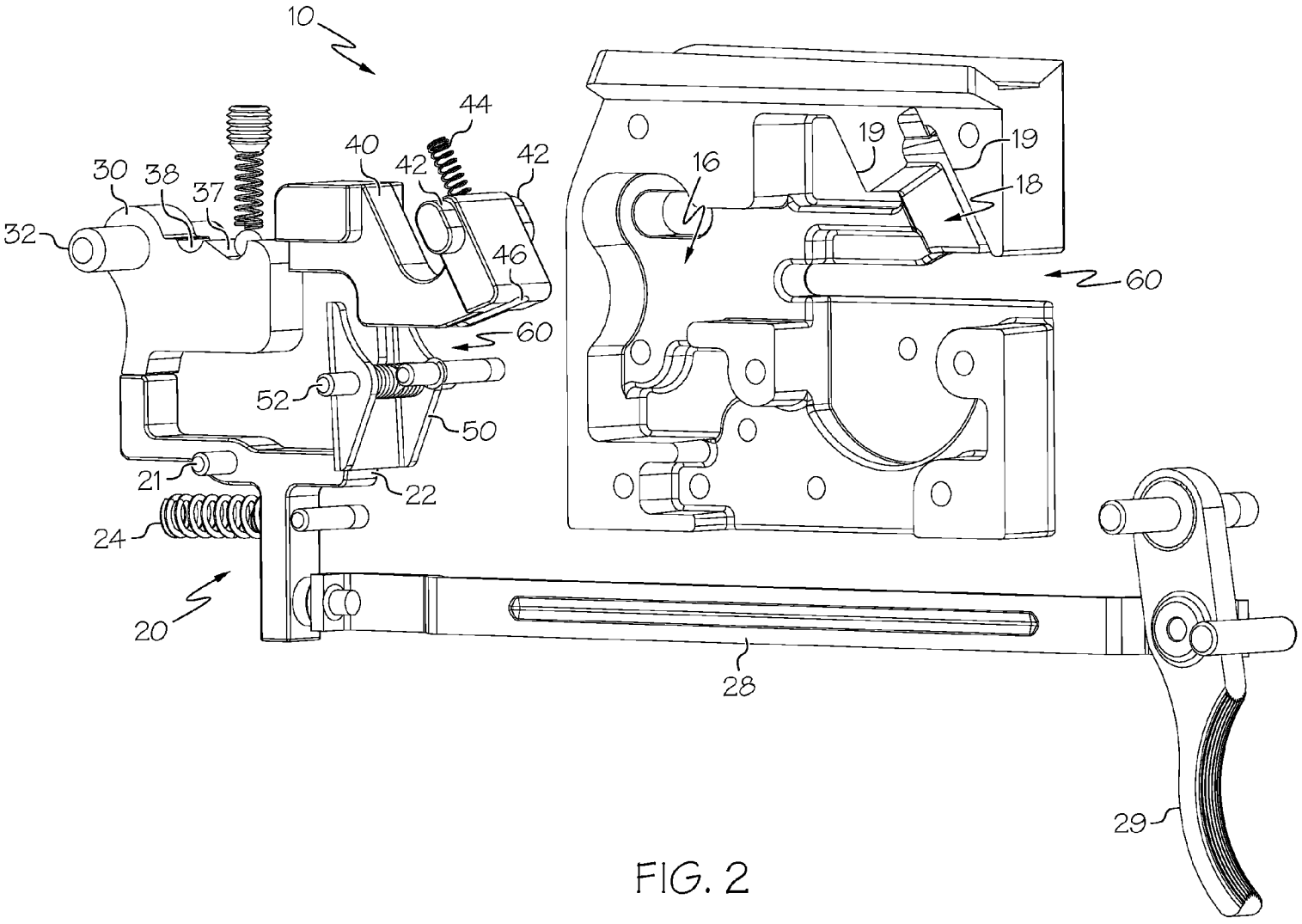
Figure 3:
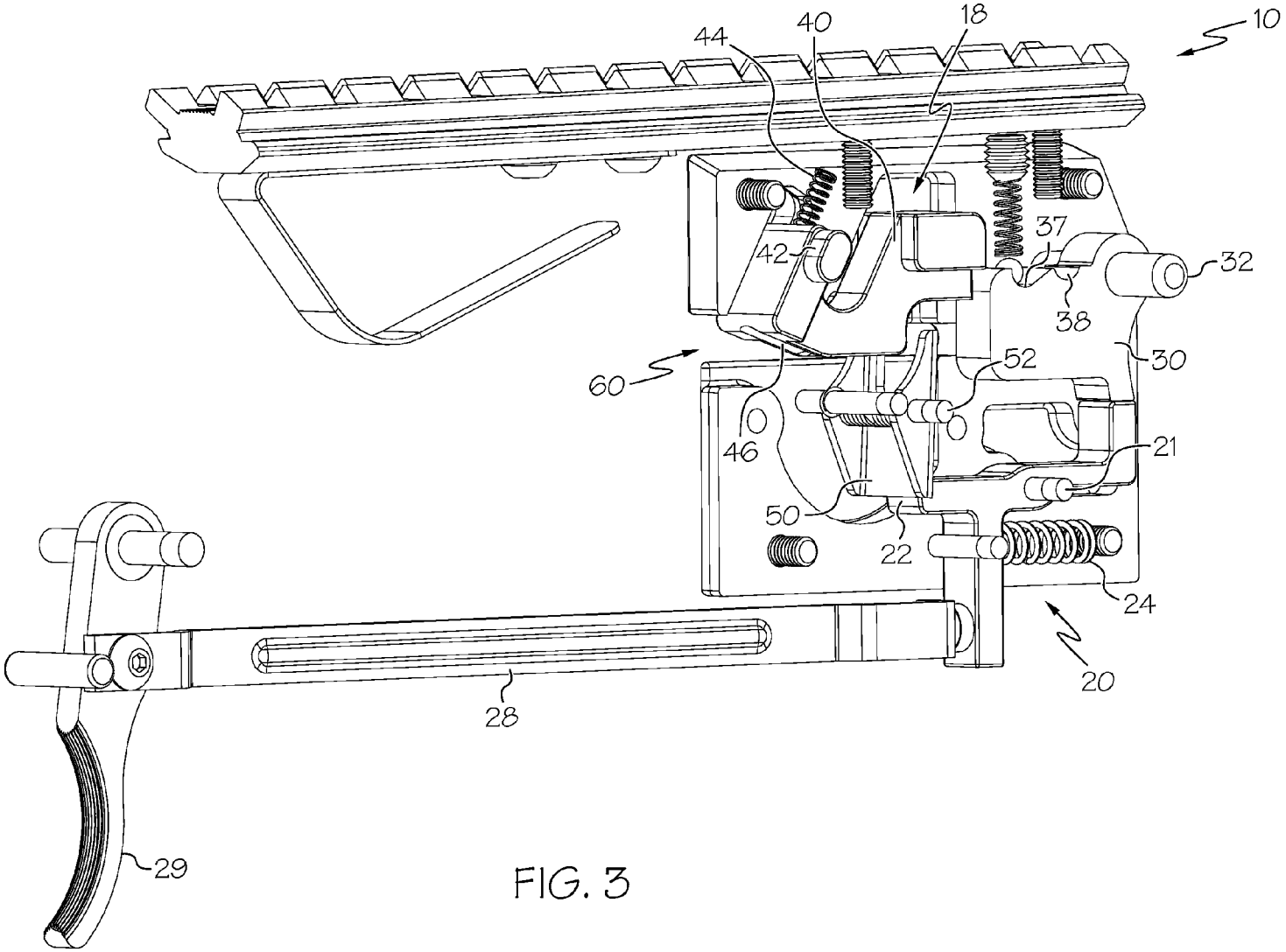

FIG. 1 shows an embodiment of a trigger assembly 10 comprising a trigger mechanism 20, a safety 30 and an anti-dry fire mechanism comprising an arrow sensor 40. The assembly 10 comprises a housing 12 comprising a first portion 13 and a second portion 14. The housing 12 defines an internal cavity having several portions for receiving the various components therein. FIG. 1 shows the housing 12 second portion 14 spaced away such that the internal components of the assembly 10 are visible. FIG. 2 shows a view from an angle similar to that of FIG. 1, but the housing 12 second portion 14 has been omitted and the housing 12 first portion 13 is spaced away from the internal components. FIG. 3 shows a view from an opposite angle, wherein the housing 12 first portion 13 has been omitted.

The assembly 10 comprises a slot 60 arranged to receive a bowstring. A string catch 50 is arranged to catch and retain a bowstring in the slot 60. Desirably, the string catch 50 is moveable between first and second orientations, wherein the string catch 50 retains the bowstring while in the first orientation (e.g. cocked) and releases the bowstring while transitioning to the second orientation. In some embodiments, the string catch 50 comprises a rotatable member, for example arranged to rotate about a pivot pin 52.

Desirably, the string catch 50 interacts with the trigger 20 such that operation of the trigger 20 releases the string catch 50. Desirably, the trigger 20 is moveable between first and second positions. In some embodiments, when the trigger 20 is in its first position, it holds the string catch 50 in its first orientation (e.g. cocked). When the trigger 20 is moved to its second position, it releases the string catch 50, allowing the string catch 50 to transitioning to the second orientation and release the bowstring.

In some embodiments, the trigger 20 comprises a sear 22 arranged to contact a sear 54 (see FIG. 4) on the string catch 50. As the trigger 20 is operated and moved from its first position to its second position, the trigger sear 22 slides against the string catch sear 54 until the trigger 20 clears the string catch 50 and the bowstring is released.

In some embodiments, the trigger 20 comprises a pivoting member arranged to pivot between its first and second positions, for example pivoting about a pivot pin 21.

In some embodiments, the trigger 20 comprises a biasing member 24 arranged to bias the trigger 20 toward its first position.

In some embodiments, the trigger 20 comprises an arm 26 that extends out of the housing 12. In some embodiments, a trigger 20 further comprises one or more linkages 28 and a finger portion 29, wherein actuation of the trigger 20 may be achieved by actuating the finger portion 29.

The safety 30 is located in a safety cavity 16 portion of the cavity defined in the housing 12. Desirably, the safety 30 is moveable between first (e.g. safe) and second (e.g. fire) orientations. When the safety 30 is in the first (e.g. safe) orientation, desirably the trigger 20 cannot be operated. For example, when the safety 30 is in the first (e.g. safe) orientation, the safety 30 interferes with operation of the trigger 20, retaining the trigger 20 in its first position and preventing the trigger 20 from transitioning to its second position.

In some embodiments, the safety 30 directly abuts the trigger 20. For example, the safety 30 can contact the trigger 20 unless the safety 30 is in the second (e.g. fire) orientation.

In some embodiments, the safety 30 is arranged to travel along a linear path between the first (e.g. safe) and second (e.g. fire) orientations. In some embodiments, the safety cavity 16 of the housing 12 defines guide walls 17 arranged to confine movement of the safety 30 to the linear path. In some embodiments, the guide walls 17 extend parallel to the linear path.

In some embodiments, the safety 30 comprises a handle 32 configured to extend through an aperture 72 in the housing 12. Desirably, a user of the crossbow can move the safety 30 between the first (e.g. safe) and second (e.g. fire) orientations by moving the handle 32.

In some embodiments, the safety 30 comprises a first detent 37 and a second detent 38. Desirably, the first detent 37 corresponds to the first (e.g. safe) orientation and the second detent 38 corresponds to the second (e.g. fire) orientation. The safety 30 can further comprise a detent spring 34 and a detent ball 36 (for example received in the housing 12) arranged to engage the detents 37, 38. Desirably the detent system encourages the safety 30 to be in either the first (e.g. safe) orientation or the second (e.g. fire) orientation.

The arrow sensor 40 is located in an arrow sensor cavity 18 portion of the cavity defined in the housing 12. Desirably, the arrow sensor 40 is configured to prevent firing the crossbow unless an arrow is present. Desirably, the arrow sensor 40 is moveable between first and second orientations. In some embodiments, a biasing member 44 is provided to bias the arrow sensor 40 toward its first orientation.

Desirably, in the first orientation (e.g. arrow not present), the arrow sensor 40 is positioned to interfere with operation of the safety 30 and prevent the safety 30 from assuming its second (e.g. fire) orientation. Thus, if an arrow is not present, the arrow sensor 40 will prevent trigger 20 actuation via the safety 30.

The arrow sensor 40 is configured to move into its second orientation when an arrow is placed in a position to be fired (e.g. placed into the slot 60). Moving the arrow sensor 40 into its second position provides clearance for the safety 30, and allows the safety 30 to be moved into its second (e.g. fire) orientation.

In some embodiments, the arrow sensor 40 is arranged to travel along a linear path between the first (e.g. arrow not present) and second orientations. In some embodiments, the arrow sensor cavity 18 of the housing 12 defines guide walls 19 arranged to confine movement of the arrow sensor 40 to the linear path. In some embodiments, the guide walls 19 extend parallel to the linear path.

In some embodiments, the arrow sensor 40 comprises one or more tabs 42, wherein each tab 42 is arranged to move within a guide channel 74 defined in the housing. For example, the arrow sensor cavity 18 of the housing 12 can define a guide channel 74. In some embodiments, the housing 12 comprises an aperture 75, and a tab 42 extends through the aperture 75. This allows a user to visually verify whether the arrow sensor 40 is in the first or second orientation. In some embodiments, an aperture 75 comprises a guide channel 74.

In some embodiments, the arrow sensor 40 comprises one or more protrusions 48, wherein each protrusion 48 is received in a portion of the arrow sensor cavity 18. In some embodiments, one or more portions of a protrusion 48 contact one or more walls that define the arrow sensor cavity 18 to limit movement of the arrow sensor 40.

In some embodiments, the arrow sensor 40 comprises a guide channel 46. Desirably, the guide channel 46 is aligned with an arrow firing axis, such that the guide channel 46 encourages proper placement of an arrow. For example, as shown in FIG. 1, the guide channel 46 is centered in the arrow sensor 40 above an arrow firing axis, and the guide channel 46 will help keep an arrow centered on the arrow firing axis.

Figure 4:
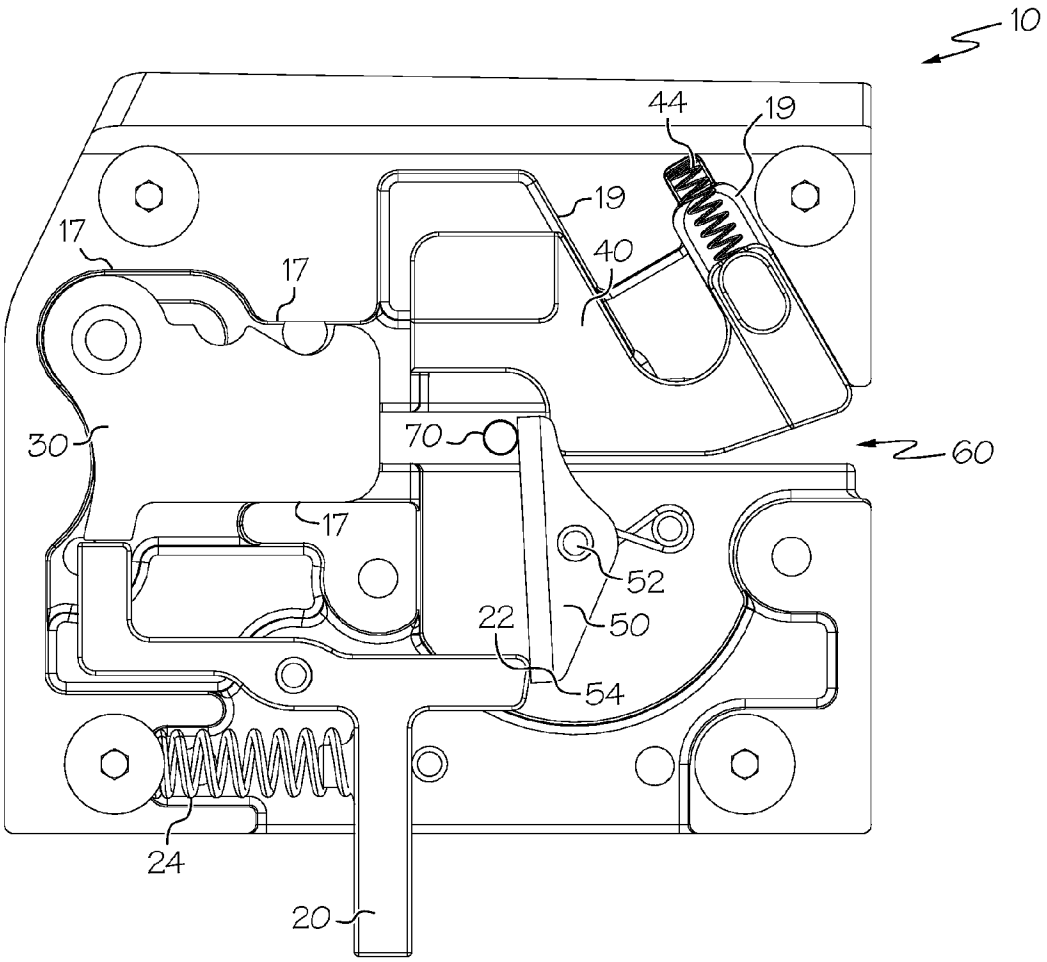
FIGS. 4-8 show the embodiment of FIGS. 1-3 at various stages of operation.

FIGS. 4-8 show various stages of operation of the assembly 10. FIG. 4 shows the assembly 10 in a cocked orientation, wherein the bowstring 70 is retained in the slot 60 by the string catch 50. The trigger 20 is in its first position, thus abutting the sear 54 of the string catch 50 and preventing rotation of the string catch 50. It can be noted that the string catch 50 does not interact with the arrow sensor 40, as the string catch 50 is provided with a clearance notch (see FIGS. 1 and 2). FIG. 4 does not include an arrow, and the arrow sensor 40 is in its first orientation (e.g. arrow not present).

Figure 5:
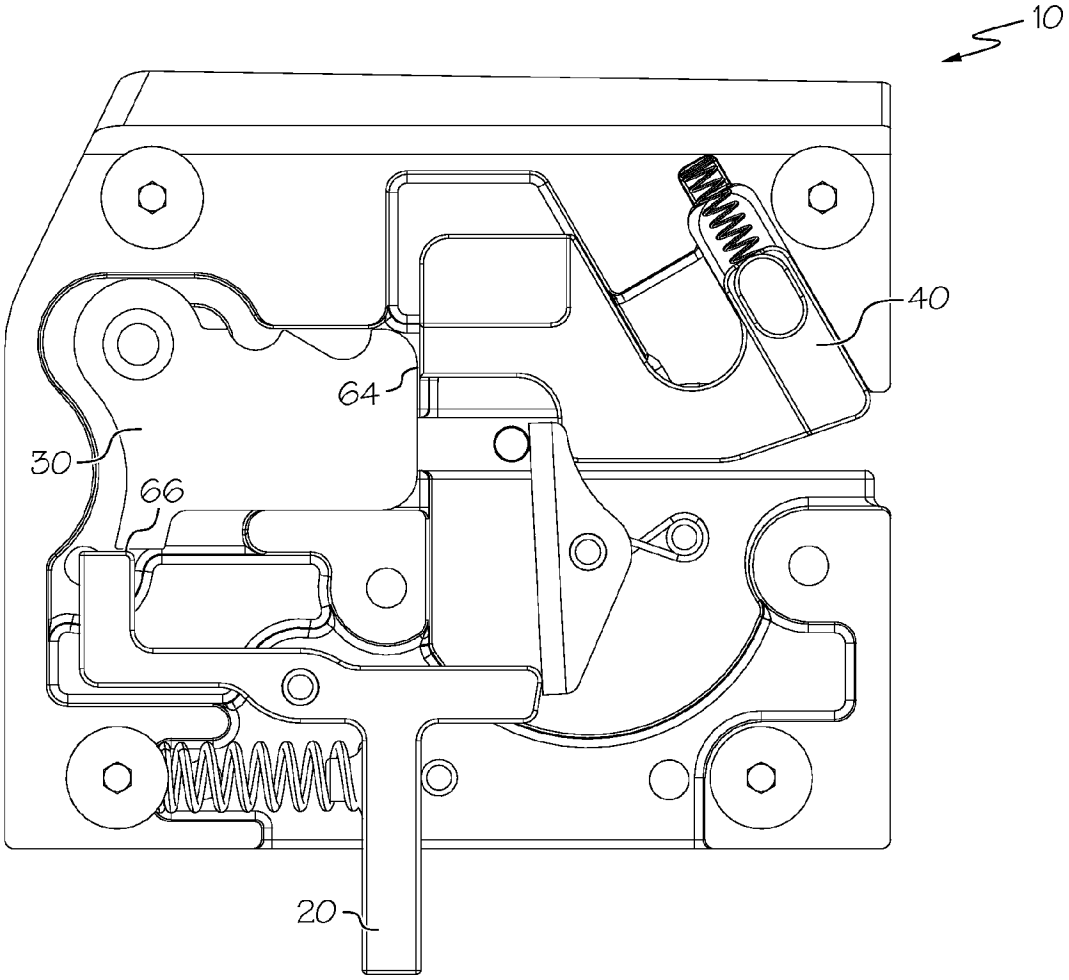

FIG. 5 shows the assembly 10 in an orientation similar to that of FIG. 4; however, the safety 30 has been moved in an attempt to move the safety 30 into its second (e.g. fire) orientation. The arrow sensor 40 remains in its first orientation (e.g. arrow not present) and therefore prevents the safety 30 from reaching its second (e.g. fire) orientation. A first contacting portion 64 of the safety 30 contacts the arrow sensor 40. Simultaneously, a second contacting portion 66 of the safety 30 contacts the trigger 20 and prevents actuation of the trigger 20.

Figure 6:
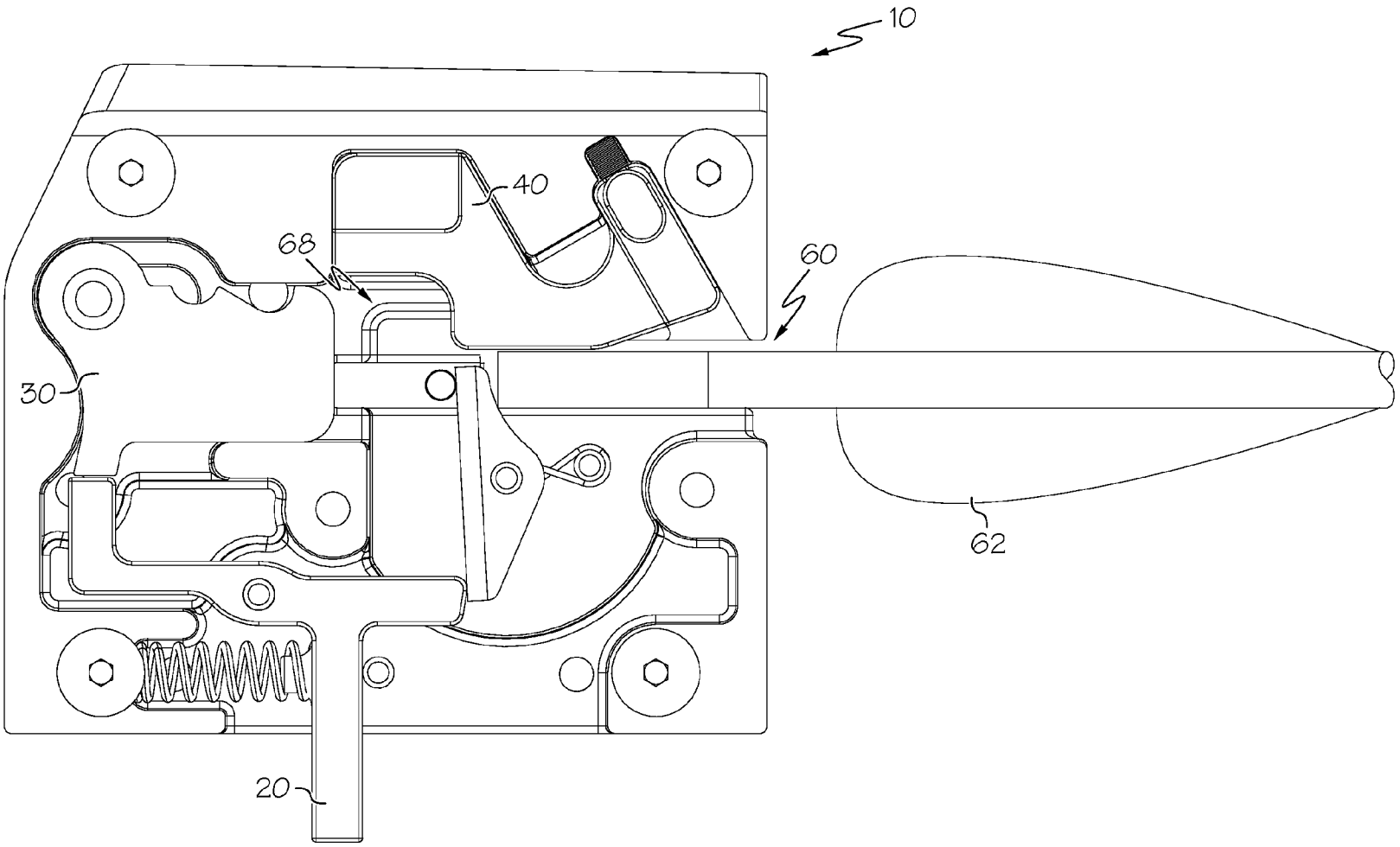

FIG. 6 shows the assembly 10 in a cocked orientation. An arrow 62 has been placed in the slot 60. The presence of the arrow 62 moves the arrow sensor 40 to its second orientation. An area of clearance 68 is thereby provided for the safety 30.

Figure 7:
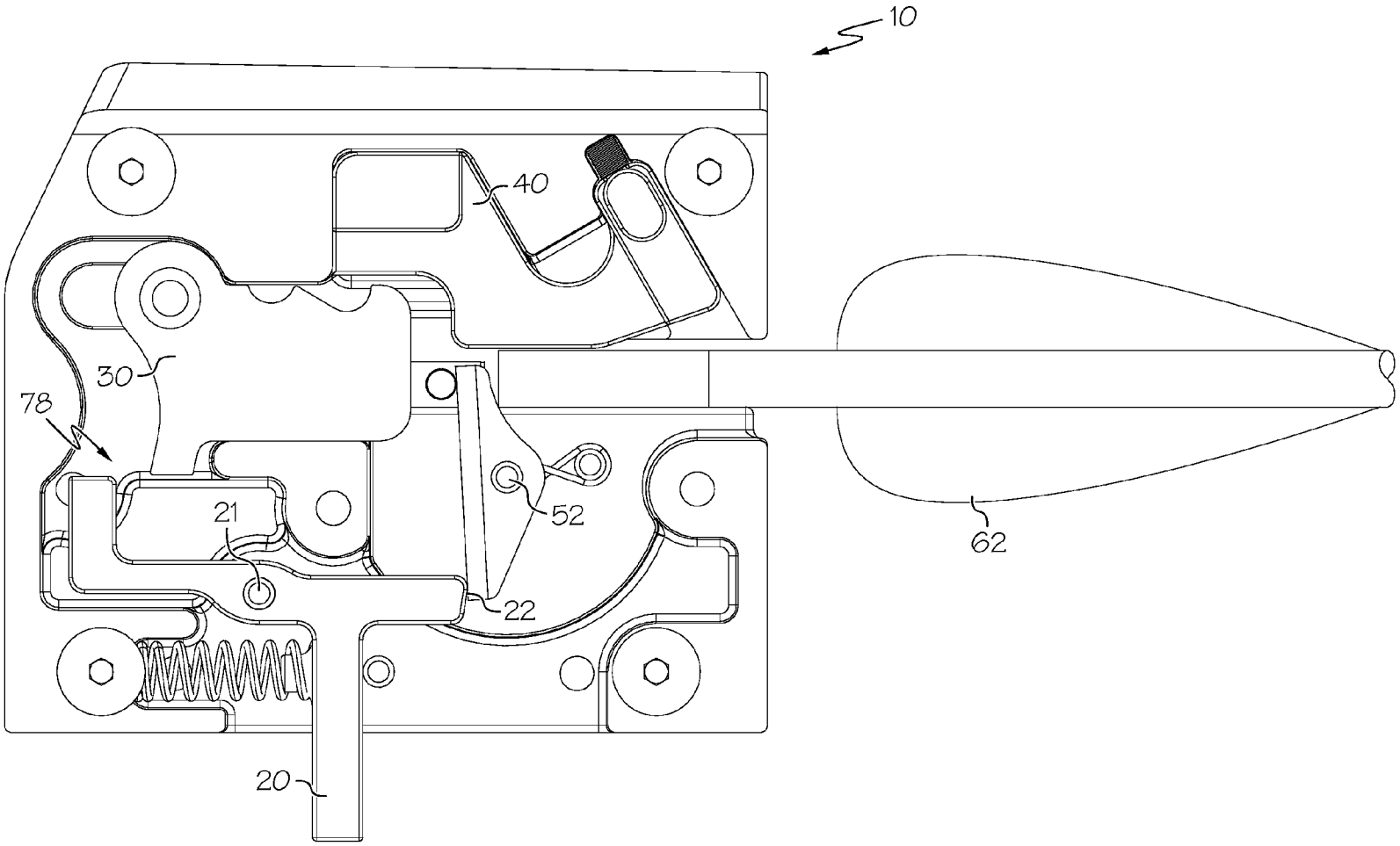

FIG. 7 shows the assembly 10 in a cocked orientation with an arrow 62 present. The safety 30 has been moved into its second (e.g. fire) orientation, thereby providing an area of clearance 78 for the trigger 20 to be operated.

Figure 8:
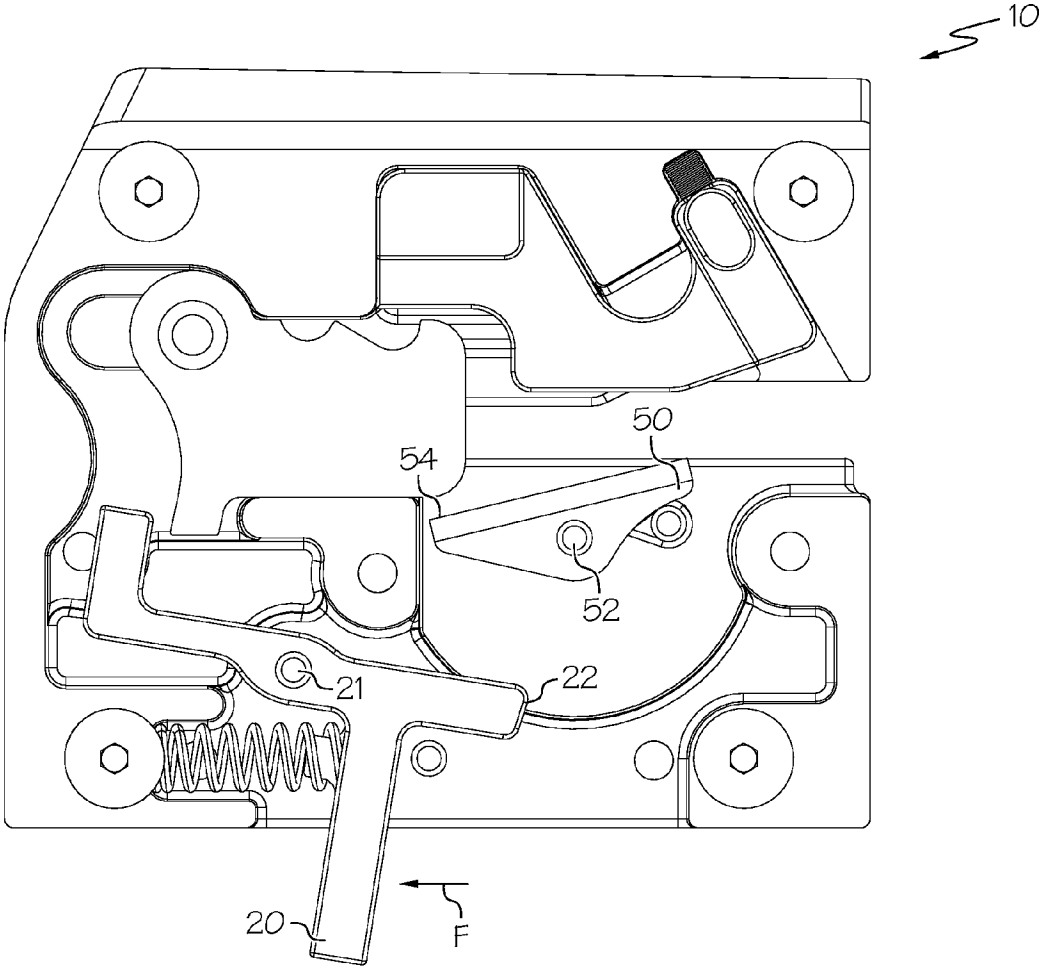

FIG. 8 shows the assembly after firing. A force F has been applied to the trigger 20, causing the trigger 20 to rotate about its pivot 21. The rotation caused the trigger sear 22 to clear the string catch sear 54, allowing the string catch 50 to rotate about its pivot 52 and release the bowstring.

Figure 9:
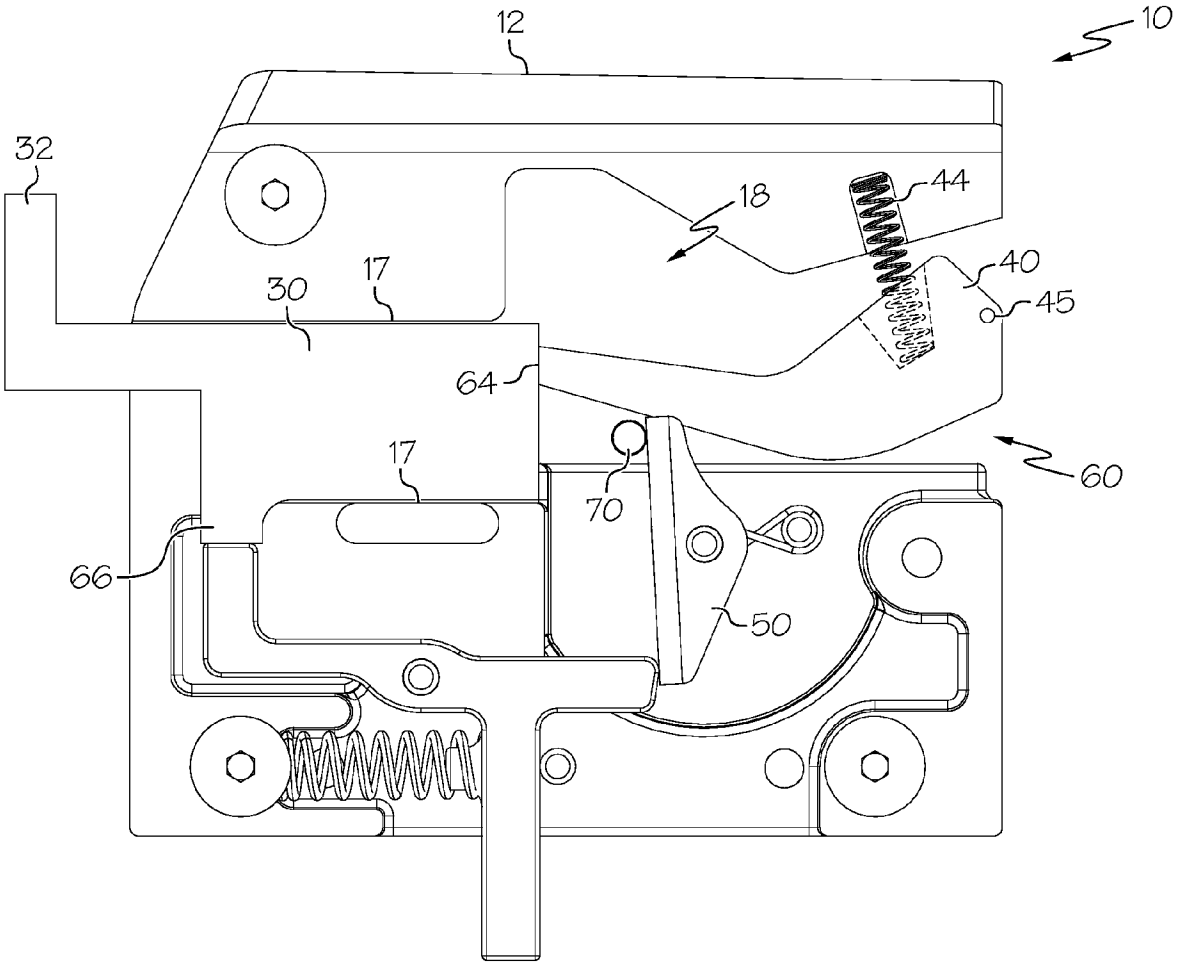
FIGS. 9 and 10 show another embodiment of a trigger assembly at various stages of operation.

FIG. 9 shows another embodiment of a trigger assembly 10.

In some embodiments, the arrow sensor 40 is arranged to pivot between the first and second orientations, for example rotating about a pivot axis 45, such as a pivot pin received in the housing 12.

FIG. 9 shows the assembly 10 in a cocked orientation, wherein the bowstring 70 is retained in the slot 60 by the string catch 50. The trigger 20 is in its first position, preventing rotation of the string catch 50. The arrow sensor 40 is in its first orientation (e.g. arrow not present), and the safety 30 is in its first (e.g. safe) orientation. The arrow sensor 40 contacts the safety 30 and prevents the safety 30 from reaching its second (e.g. fire) orientation. A first contacting portion 64 of the safety 30 contacts the arrow sensor 40. Simultaneously, a second contacting portion 66 of the safety 30 contacts the trigger 20 and prevents actuation of the trigger 20.

In some embodiments, a handle 32 of the safety 30 extends out of the housing 12 in a rearward direction, for example exiting the housing 12 on the opposite side of the slot 60.

Figure 10:
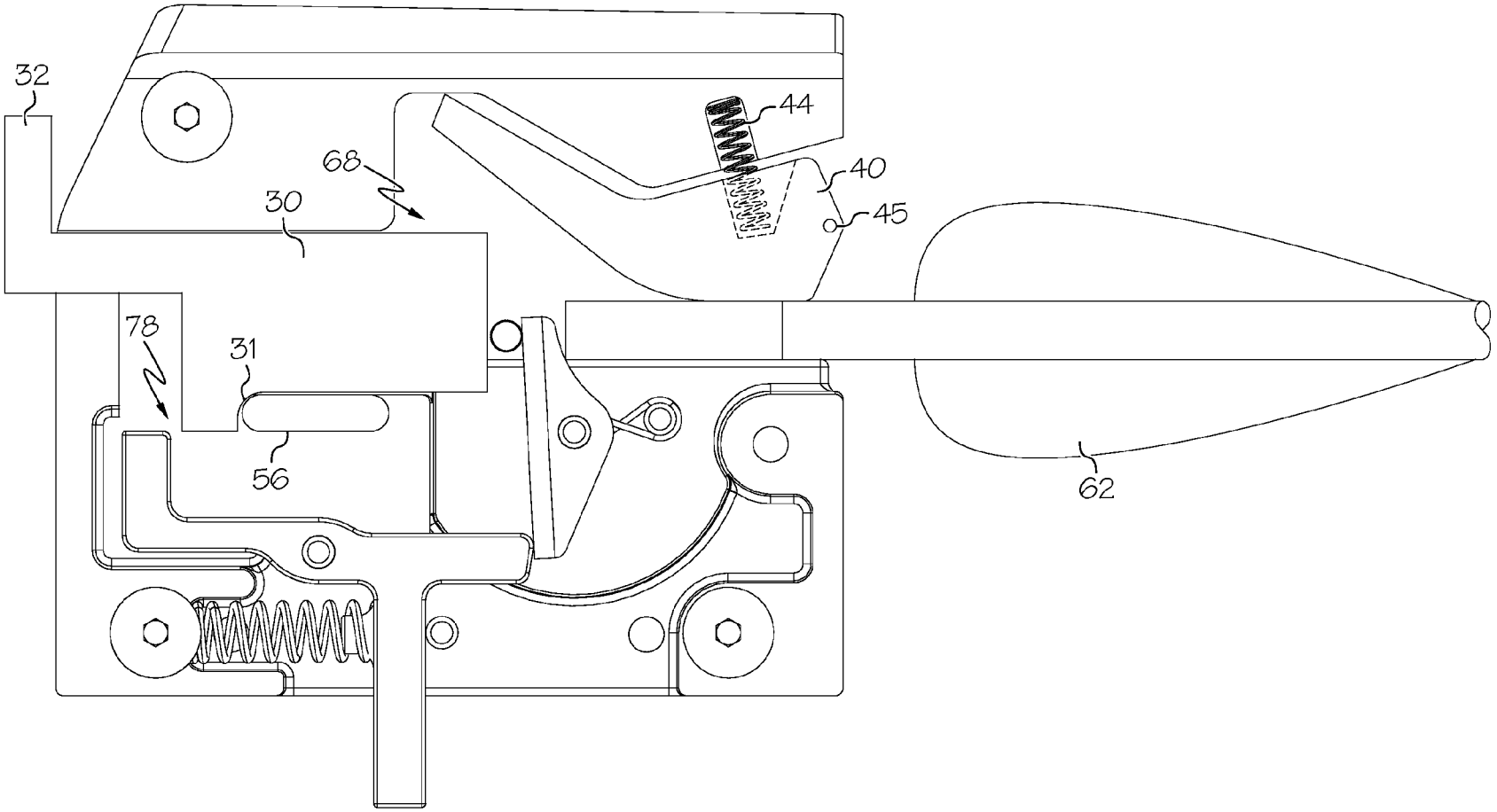

FIG. 10 shows the assembly 10 of FIG. 9 with an arrow 62 present. The presence of the arrow 62 moves the arrow sensor 40 to its second orientation. An area of clearance 68 is thereby provided for the safety 30. The safety 30 has been moved into its second (e.g. fire) orientation, thereby providing an area of clearance 78 for the trigger 20 to be operated.

FIG. 10 also shows a design of the safety handle 32 arranged to limit travel of the safety 40 by abutting the housing 12 when in the second (e.g. fire) orientation. A shaped portion 31 of the safety 30 is also arranged to abut a flange 56 of the housing 12 to limit travel of the safety 30.

In some embodiments, the arrow sensor 40 comprises a unitary body member. In some embodiments, the arrow sensor 40 is formed from a single piece of material. In some embodiments, the unitary body arrow sensor 40 is arranged to directly contact an arrow positioned to be fired.

In some embodiments, the safety 30 comprises a unitary body member. In some embodiments, the safety 30 is formed from a single piece of material. In some embodiments, the unitary body safety 30 is arranged to directly contact the trigger 20 and also to directly contact the arrow sensor 40 simultaneously. In some embodiments, the unitary body safety 30 is arranged to directly contact a portion of the trigger 20 that comprises the sear 22, and also to directly contact the arrow sensor 40 simultaneously.

The trigger assemblies 10 and various components thereof can be formed from any suitable materials, such as metals, composites, plastics having suitable strength, various combinations thereof, etc.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow trigger assembly comprising:

a housing comprising a guide channel, said guide channel being symmetrical across a longitudinal axis;

a string catch;

a trigger arranged to release said string catch upon actuation of said trigger;

a safety member moveable between safe and fire orientations, said safety member preventing actuation of said trigger in said safe orientation; and an arrow sensing member moveable between first and second orientations along a linear axis, said arrow sensing member preventing said safety member from assuming said fire orientation when said arrow sensing member is in said first orientation, said arrow sensing member comprising a tab arranged to slide in said guide channel, said longitudinal axis of said guide channel being parallel to said linear axis;

said safety member comprising a continuous body having a first portion and a second portion, said first portion contacting said arrow sensing member, said second portion contacting said trigger.

2. The crossbow trigger assembly of claim 1, wherein said arrow sensing member comprises a contacting surface arranged to contact an arrow, said contacting surface comprising a slot.

3. The crossbow trigger assembly of claim 1, comprising a biasing member arranged to bias said arrow sensing member toward said first orientation.

4. The crossbow trigger assembly of claim 1, wherein said safety member is moveable along a linear path.

5. The crossbow trigger assembly of claim 1, wherein said safety member comprises a first detent and a second detent, said first detent corresponding to said safe orientation and said second detent corresponding to said fire orientation.

6. The crossbow trigger assembly of claim 1, wherein said arrow sensing member comprises an arrow guide slot.

7. The crossbow trigger assembly of claim 1, wherein said arrow sensing member comprises a second tab arranged to slide in a second guide channel said housing.

8. The crossbow trigger assembly of claim 1, wherein said safety member comprises a handle extending through an aperture in said housing.

9. The crossbow trigger assembly of claim 8, wherein said aperture is located on a sidewall of said housing.

10. The crossbow trigger assembly of claim 8, wherein said aperture is located on a rear wall of said housing.

11. The crossbow trigger assembly of claim 1, wherein said arrow sensing member comprises a single body.

12. The crossbow trigger assembly of claim 11, wherein said trigger comprises a single body arranged to contact said string catch and said safety member.

13. The crossbow trigger assembly of claim 1, wherein said trigger comprises a single body arranged to contact said string catch and said safety member.

14. The crossbow trigger assembly of claim 1, said arrow sensing member assuming said second orientation when an arrow is present, said arrow sensing member not preventing said safety member from assuming said fire orientation when said arrow sensing member is in said second orientation.

15. A crossbow trigger assembly comprising:

a housing comprising an elongate guide channel at least partially defined by a flat surface;

a string catch;

a trigger arranged to release said string catch upon actuation of said trigger, said trigger comprising a single body;

a safety member moveable between safe and fire orientations, said safety member preventing actuation of said trigger in said safe orientation; and an arrow sensing member slideable between first and second orientations along a linear axis, said arrow sensing member preventing said safety member from assuming said fire orientation when said arrow sensing member is in said first orientation, said arrow sensing member comprising a tab arranged to slide in said elongate guide channel, said flat surface being parallel to said linear axis;

wherein said safety member comprises a continuous body arranged to contact said trigger and said arrow sensing member simultaneously.

16. The crossbow trigger assembly of claim 15, wherein said arrow sensing member comprises a body arranged to contact said safety in said first orientation and to contact an arrow in said second orientation.

17. The crossbow trigger assembly of claim 15, said arrow sensing member assuming said second orientation when an arrow is present, said arrow sensing member not preventing said safety member from assuming said fire orientation when said arrow sensing member is in said second orientation.

18. A crossbow trigger assembly comprising:

a housing comprising an elongate guide slot, said guide slot at least partially defined by opposed parallel sidewalls;

a string catch;

a trigger arranged to release said string catch upon actuation of said trigger, said trigger comprising a single body;

a safety member comprising a single body moveable between safe and fire orientations, said safety member preventing actuation of said trigger in said safe orientation; and an arrow sensing member comprising a single body moveable between first and second orientations along a linear axis, said arrow sensing member preventing said safety member from assuming said fire orientation when said arrow sensing member is in said first orientation, said arrow sensing member comprising a tab arranged to slide in said elongate guide slot, said opposed parallel sidewalls being parallel to said linear axis;

wherein said safety member contacts said trigger and said arrow sensing member simultaneously.

19. The crossbow trigger assembly of claim 15, said arrow sensing member comprising a continuous body having a first portion and a second portion, said first portion arranged to contact an arrow, said second portion arranged to contact said safety member.

* * * * *